US010550842B2

(12) United States Patent
Garside

(10) Patent No.: US 10,550,842 B2
(45) Date of Patent: Feb. 4, 2020

(54) EPITROCHOIDAL TYPE COMPRESSOR

(71) Applicant: Epitrochoidal Compressors Ltd, Cobham, Surrey (GB)

(72) Inventor: David Walker Garside, Cobham (GB)

(73) Assignee: Epitrochoidal Compressors Ltd, Huddersfield (GB)

( * ) Notice: Subject to any disclaimer, the term of this patent is extended or adjusted under 35 U.S.C. 154(b) by 71 days.

(21) Appl. No.: 15/326,621

(22) PCT Filed: Jul. 15, 2015

(86) PCT No.: PCT/GB2015/052040
§ 371 (c)(1),
(2) Date: Jan. 16, 2017

(87) PCT Pub. No.: WO2016/009197
PCT Pub. Date: Jan. 21, 2016

(65) Prior Publication Data

US 2017/0204857 A1 Jul. 20, 2017

(30) Foreign Application Priority Data

Jul. 17, 2014 (GB) ..... 1412739.3

(51) Int. Cl.
*F01C 19/12* (2006.01)
*F01C 19/06* (2006.01)
(Continued)

(52) U.S. Cl.
CPC ..... *F04C 18/22* (2013.01); *F04C 25/02* (2013.01); *F04C 27/006* (2013.01); *F04C 27/02* (2013.01);
(Continued)

(58) Field of Classification Search
CPC ..... F04C 18/22; F04C 2/22; F04C 27/006; F01C 1/22; F01C 19/02
(Continued)

(56) References Cited

U.S. PATENT DOCUMENTS 3,042,009 A * 7/1962 Froede ..... F02B 55/04 418/142
3,758,243 A * 9/1973 Fox, Jr. ..... F01O 19/10 418/76
(Continued)

FOREIGN PATENT DOCUMENTS

| | | |
|---|---|---|
| DE | 11 88 363 B | 3/1965 |
| GB | 2215403 A | 9/1989 |
| WO | WO1988/001696 A1 | 3/1988 |

OTHER PUBLICATIONS

Harley, "Wankel's emphasis on Compressors: Research at teh Wankel Institute is centred more on compressors than engines," The Engineer, pp. 50-53 (Feb. 15, 1979).
(Continued)

*Primary Examiner* — Deming Wan
(74) *Attorney, Agent, or Firm* — Crawford Maunu PLLC

(57) ABSTRACT

A rotary piston compressor is disclosed, comprising a housing having an epitrochoidal shaped inner bore, peripheral inlet and exhaust ports located in the bore, and a rotary piston rotatably mounted within the housing. The central portion of each rotary piston flank is configured such that, at the closest point between the flank central portion and the housing between the exhaust port of the trailing compression cycle and the inlet port of the leading compression cycle, the radial spacing between the rotary piston flank and the housing is maintained such that the volumes enclosed by the rotary piston on either side of the closest point in the respective trailing and leading compression cycles are substantially sealed from one another. The end portions of each
(Continued)

rotary piston flank are configured such that radial spacing between the rotary piston flank and the housing exceeds that between the central portion and the housing.

23 Claims, 4 Drawing Sheets

(51) Int. Cl.

| | |
|---|---|
| ***F01C 19/02*** | (2006.01) |
| ***F04C 18/22*** | (2006.01) |
| ***F04C 25/02*** | (2006.01) |
| ***F04C 27/00*** | (2006.01) |
| ***F04C 27/02*** | (2006.01) |
| ***F04C 29/00*** | (2006.01) |

(52) U.S. Cl.
CPC ..... *F04C 29/0007* (2013.01); *F04C 2220/10* (2013.01); *F04C 2240/30* (2013.01)

(58) Field of Classification Search
USPC ..... 418/97, 99, 61.1, 61.2, 142, 76, 77, 150, 418/91
See application file for complete search history.

(56) References Cited

U.S. PATENT DOCUMENTS

| | | | | | |
|---|---|---|---|---|---|
| 3,913,706 | A | * | 10/1975 | Ernest | F01O 21/04 184/6.5 |
| 3,923,434 | A | * | 12/1975 | Walters | F01C 19/02 418/122 |
| 3,990,817 | A | | 11/1976 | Ruf et al. | |
| 4,047,856 | A | * | 9/1977 | Hoffman | F01C 1/22 418/183 |
| 4,150,926 | A | | 4/1979 | Eiermann | |
| 4,218,199 | A | | 8/1980 | Eiermann | |
| 4,551,083 | A | | 11/1985 | Hoffmann | |
| 5,410,998 | A | * | 5/1995 | Paul | F01C 19/04 123/204 |
| 8,662,052 | B2 | * | 3/2014 | Garside | F02B 41/02 123/200 |

OTHER PUBLICATIONS

Ogura, "The Ogura-Wankel Compressor—Application of Wankel Rotary Concept as Automotive Air Conditioning Compressor," Internatoinal Congress & Exposition, SAE Tech. Paper # 820159 (Feb. 1, 1982).

* cited by examiner

EPITROCHOIDAL TYPE COMPRESSOR

The present invention relates to rotary positive displacement compressors, more particularly to the so called Wankel type compressor in which a rotary piston rotates inside an epitrochoidal shaped housing.

BACKGROUND OF THE INVENTION

Note that any discussion of the prior art throughout the specification should in no way be considered as an admission that such prior art is widely known or forms part of common general knowledge in the field.

All positive displacement type compressors suffer to a greater or lesser extent from possessing a higher than desirable 'dead volume' (hereafter DV). The DV is the volume remaining in the working chamber after the piston has reached the TDC position. Ideally, that volume would generally be zero. The outcome of it not being zero is that the compressed gas remaining in the DV is then not forced out through the exit valve into a receiving vessel, but is re-expanded by movement of the piston and is returned to the next intake stroke. As a result the volumetric efficiency of the compressing machine is greatly impaired. Therefore to then achieve the desired quantity of delivered compressed gas requires that the machine has to possess a larger swept volume. A larger machine implies increased weight, bulk and manufacturing cost as well as increased mechanical friction and other energy losses.

A range of potential Wankel-type compressor concepts exist which incorporate epitrochoidal type housings. The most promising are the type with a three cornered rotor rotating inside a two lobed epitrochoidal housing; and the similarly principled type with a two cornered rotor inside a one lobed housing. The former (conventionally designated the 2:3 type, the latter being the 1:2 type) has been built by several manufacturers as an IC engine in considerable volume. However, when first proposed some 60 years ago, both types were equally put forward as potential gas compressors.

The main reason that the 2:3 type has failed to be successful in the market place for the compressor application is related to the DV problem. In a practical current-art design, the DV is typically 10 to 16% which is too high for an efficient machine. It is true that if a higher R/e value is selected, ("R" being the radius of the rotor and "e" being the eccentricity of the shaft on which the rotor is mounted), then a somewhat lower DV can be achieved. But a greater R/e results in a bigger and heavier machine with higher mechanical friction.

The alternative 1:2 type can achieve a DV significantly lower than the 2:3 type, particularly if a higher R/e value is selected. Therefore considerably more efforts have been made in the past to develop such a 1:2 compressor. However, when utilising such a high R/e value, this 1:2 machine then suffers from possessing a very small diameter stationary gear and drive shaft with considerably less than the ideal torque capability. If any significant dynamic torque loading were then to occur, due to dynamic torsional vibration acting on the input drive shaft as may be caused by the inherent and known torque reversal problem for example (as discussed in U.S. Pat. No. 4,218,199A), the gear or shaft may be overstressed and fail. Hence this type has not proved suitable for general industrial usage.

Some features of a potential design of epitrochoidal type compressor are presented in patent application no. GB2215403 (The Hydrovane Compressor Company Limited). This document also lists the many problems, particularly relating to high friction losses, associated with the sliding vane type of positive displacement compressor. These problems lead to low energy efficiency, particularly when operating at higher speeds or part load or producing pressure greater than 4 bar or so. Nevertheless many manufacturers currently supply large numbers of this type to the market place, despite the need for higher energy efficiency having become an increasingly important consideration.

In an attempt to provide a compressor with increased efficiency relative to the sliding vane type GB2215403 identified the rotary type with epitrochoidal housing as a promising candidate, particularly with regard to its superior gas sealing principles, mechanical efficiency, and part-load control characteristics. GB2215403 identifies the need to seal the HP chamber from the LP chamber around the TDC position; and proposed to use stationary seal pieces located in the inner surface of the housing circumferentially positioned at the minor axis of the housing which engage with the flank surface of the rotor to achieve this end.

However when the chamber positioned in the vicinity of the TDC position is divided into two sectors by the presence of such sealing means, the gas pressure now acting on the two areas of the rotor flanks on either side of the seal is very disparate. This results in a high torque being applied to the rotor which then imposes a high load on some teeth of the rotor and stationary gears in a repetitive and cyclic manner. Therefore, unless special design considerations are applied, these gears would probably suffer fatigue failure if the machine was used to produce gas pressure in the frequently required range of 5 to 8 bar or higher. GB2215403 failed to identify or hence address this important issue; and the design is therefore deficient.

By utilising stationary seal pieces located at each minor axis in the housing, the design of GB2215403 is unable to utilise the conventional arrangement of apex seals located at the apices of the rotor, such rotating seals being generally incompatible with the design to use a stationary seal located in the housing, as each moving apex seal piece would impact with each stationary seal piece once for each revolution of the rotor and inevitably cause damage.

Hence, to avoid this second deficiency, GB2215403 proposed not to use apex seal pieces located at the rotor apices, but to rely on the necessary gas sealing at these places being achieved by designing and manufacturing the rotor to provide a very small radial working clearance of 0.1 mm maximum between the rotor outer periphery at the apices and the epitrochoidal inside surface of the housing for all positions of the rotor.

However, design and manufacturing experience with the Wankel engine indicates that it is not practical or economic to specify such a small clearance between the rotor and the bore of the housing because many tolerances are involved in the manufacture of the major related components, such as rotor with internal gear, stationary gear, eccentric shaft, end plates, and rotor housing, etc., which may each contribute additively to the required working clearance between the rotor and the housing bore.

A major contributor to this need for clearance is the necessary or inevitable backlash between the rotor and stationary gears, as well as the angular and radial location accuracy of each of these gears in their respective components. When, during rotation, the rotor apices are situated at the minor or major axis of the housing, the backlash plus gear angular location tolerances do not materially influence the radial clearance value between rotor apices and housing bore; but when the rotor apices are in between these positions the rotational "free play" of the rotor, combined with the many potential radial location errors, may allow the apices to collide with the housing surface unless a positive clearance always exists. If this mechanical contact were to occur, the machine may fail catastrophically.

Analysis of the best practical manufacturing tolerances specifically related to the design of the components of a compressor as described in GB2215403 indicates that a working clearance of about 0.2 mm minimum would generally be required. If the clearance of the rotor at the apices possessed this higher value compared to the proposed 0.1 mm, and no apex seals were fitted as described in GB2215403, then the gas leakage at the apices would be undesirably high. Hence a design of compressor as described in GB2215403 has several deficiencies and would not result in the creation of an efficient machine.

Such deficiencies as these are no doubt the reason that the design of GB2215403, or any other design of epitrochoidal type machine, has failed to be successfully marketed for the general industrial compressor application despite it now being 60 years since the Wankel principles were first announced.

The only known production machine has been a small automotive air conditioning 2:3 type compressor manufactured for a time in the 1980s, as described in SAE 820159, U.S. Pat. No. 4,150,926, and "The Engineer" on 15/2/1979. This machine employed conventional apex seals. It suffered from a DV of 16%, a low volumetric efficiency and low energy efficiency.

SUMMARY OF THE PRESENT INVENTION

The invention provides a rotary piston compressor comprising a housing having an epitrochoidal shaped inner bore, peripheral inlet and exhaust ports located in the bore, end plates for the housing, and a rotary piston rotatably mounted within the housing, wherein the rotary piston has apex seals located in the apices of the rotor, and the rotor axial end faces are in close sealing proximity to the inner surfaces of the end plates; characterised in that the profile of the central portion of each rotary piston flank is configured such that, at the closest point between the flank central portion and the housing between the exhaust port of the trailing compression cycle and the inlet port of the leading compression cycle, the radial spacing between the rotary piston flank and the housing is maintained sufficiently small such that, in use, the volumes enclosed by the rotary piston on either side of the closest point in the respective trailing and leading compression cycles are substantially sealed from one another, and in that the profiles of the end portions of each rotary piston flank are configured such that an increased radial spacing between the rotary piston flank and the housing is provided compared to that between the central portion and the housing.

By substantially sealing from one another the volumes enclosed by the rotary piston on either side of the closest point in the respective trailing and leading compression cycles, two chambers are effectively created. The leading and expanding chamber is substantially filled only with fresh low-pressure gas entering from an inlet port, and generally contains none of the compressed gas which is contained in the trailing and contracting chamber, that compressed gas being substantially all forced through the exhaust port. The outcome, at least in preferred embodiments, is a compressor with a value for the DV being close to zero as discussed further below.

The "closest point" between the flank central portion and the housing is seen when viewed axially (e.g. as in FIG. 1). In reality, because the rotor has axial depth, this point is in fact a line in the axial direction of the compressor.

In a preferred embodiment, the housing has a two-lobed epitrochoidal shaped inner bore, the compressor has a shaft journalled in the end plates, and the rotary piston has three flanks and is mounted on the shaft eccentrically with respect thereto and geared to rotate at one third speed of said shaft. Preferably, such a compressor has an R/e value of less than 5.3, as discussed further below.

In a preferred alternative embodiment, the housing has a one-lobed epitrochoidal shaped inner bore, the compressor has a shaft journalled in the end plates, and the rotary piston has two flanks and is mounted on the shaft eccentrically with respect thereto and geared to rotate at one half speed of said shaft. Preferably, such a compressor has an R/e value of less than 4.3, as discussed further below.

In either of the two-lobed or the one-lobed embodiments referred to above, the profile of the central portion of each rotary piston flank is preferably configured such that, as the shaft rotates from a position approximately 60° before TDC to approximately 60° after TDC, the volume enclosed between the rotor flank, housing bore and end plates is continuously divided into two separate chambers, one leading, one trailing, which are substantially sealed from each other by the radial closeness of a moving point (32) on the rotor flank to an associated moving point (30) on the bore of the housing.

Preferably, the profiles of the end portions of each rotary piston flank outside the central portion are configured such that the rotor flank is reduced in radial size to provide an increased radial clearance to the bore of the housing such that no part of those regions impact the bore of the housing.

The trailing chamber preferably contains pressurised gas and communicates solely with the exhaust port, the circumferential location of the port being such that it is substantially adjacent to the volume in the chamber when the volume is at a minimum. The leading chamber preferably contains low-pressure fresh intake gas and communicates solely with the peripheral inlet port, the circumferential location of the port being such that it is substantially adjacent to the volume in the chamber when the volume is at a minimum. This avoids a vacuum with resulting negative work, and achieves a high volumetric efficiency.

Preferably, as discussed above and described further below, the compressor of the invention has a dead volume of 1% or less.

In a preferred embodiment, when the rotor is positioned at the TDC position, the circumferential mid-point of the rotor flank has a radial clearance to the housing bore of 0.20 mm or less, preferably 0.10 mm or less, more preferably 0.01 mm to 0.20 mm and still more preferably 0.01 mm to 0.10 mm. The two points (32) on each rotor flank which are closest to the housing bore when the rotor is positioned 60° before and 60° after TDC preferably have a radial clearance to the housing bore which is approximately 0.1 mm greater than the clearance at the circumferential mid-point of the rotor flank to the housing bore. The rotor flank profile between the mid-point of the rotor flank and the closest points at 60° before and 60° after TDC preferably has a progressively and evenly increasing radial clearance to the housing bore.

In a preferred embodiment, the rotor flank immediately adjacent to the apices has a radial clearance to the housing bore of 0.5 mm or less and preferably 0.20 mm to 0.50 mm. Preferably, the rotor flank profile between the closest points at 60° before and 60° after TDC and the points on the rotor flank adjacent to the rotor apices has a progressively and evenly increasing radial clearance to the housing bore.

The compressor may be provided with oil in the compressor bore for the purposes of lubrication, cooling and gas sealing. Oil flooding provides copious lubrication to the sliding surfaces, augments the gas sealing quality, and provides cooling of the compressed gas and the machine components.

In a preferred embodiment, pressurised oil is supplied in use to internal cavities of the rotor. The pressurised oil may be supplied via an axial passage through one end plate, this passage being located inside the inner locus of the rotor perimeter, thereby resulting in the rotor cavities being substantially filled with pressurised oil in use. In such an embodiment, the gas sealing of the working chambers at the junction of the axial ends of the rotor and the end plates may be achieved by the pressurised oil within the rotor leaking generally outwards from the rotor interior and filling with oil the small axial gap at this junction. Holes may be provided in the rotor flanks such that oil is sprayed out from these holes into the working chambers thereby assisting the mixing with and the cooling of the compressed air in the chambers combined with depositing oil on the end casings and the housing bore surfaces. Radial holes may be provided between the rotor cavity and the apex seals which allow the pressurised oil from inside the rotor to supply oil to the apex seals.

In a preferred embodiment, the compressor may further comprise a twin gear system, whereby a stationary gear is mounted on each end plate and a ring gear is integrated into each axial end of the rotor whereby each ring gear engages with one of the stationary gears such that the gear load capability is enhanced.

The compressor of the invention may be employed as a vacuum pump as will be apparent to those skilled in the art. Accordingly, in a further aspect, the present invention relates to a vacuum pump comprising the features of the compressor as described above and below.

Objects of at least preferred embodiments the invention are to provide an improved compressor than hitherto known by addressing the long-standing and known deficiencies of the 2:3 and the 1:2 types of epitrochoidal compressors. In particular, preferred embodiments of the invention may possess:

- a very small DV and thereby high volumetric efficiency
- a special gear design to combat the ensuing unbalanced gas loads on the rotor flank
- a high quality of gas sealing via the use of oil flooding
- a capability to produce higher pressure in a single-stage machine than generally hitherto known
- a more compact machine with reduced weight, and with low mechanical friction losses by virtue of using a low R/e value combined with the small DV
- elimination of the torque reversal problem
- a resulting substantial increase in energy efficiency relative to all known types of compressors

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENTS

Figure 1:
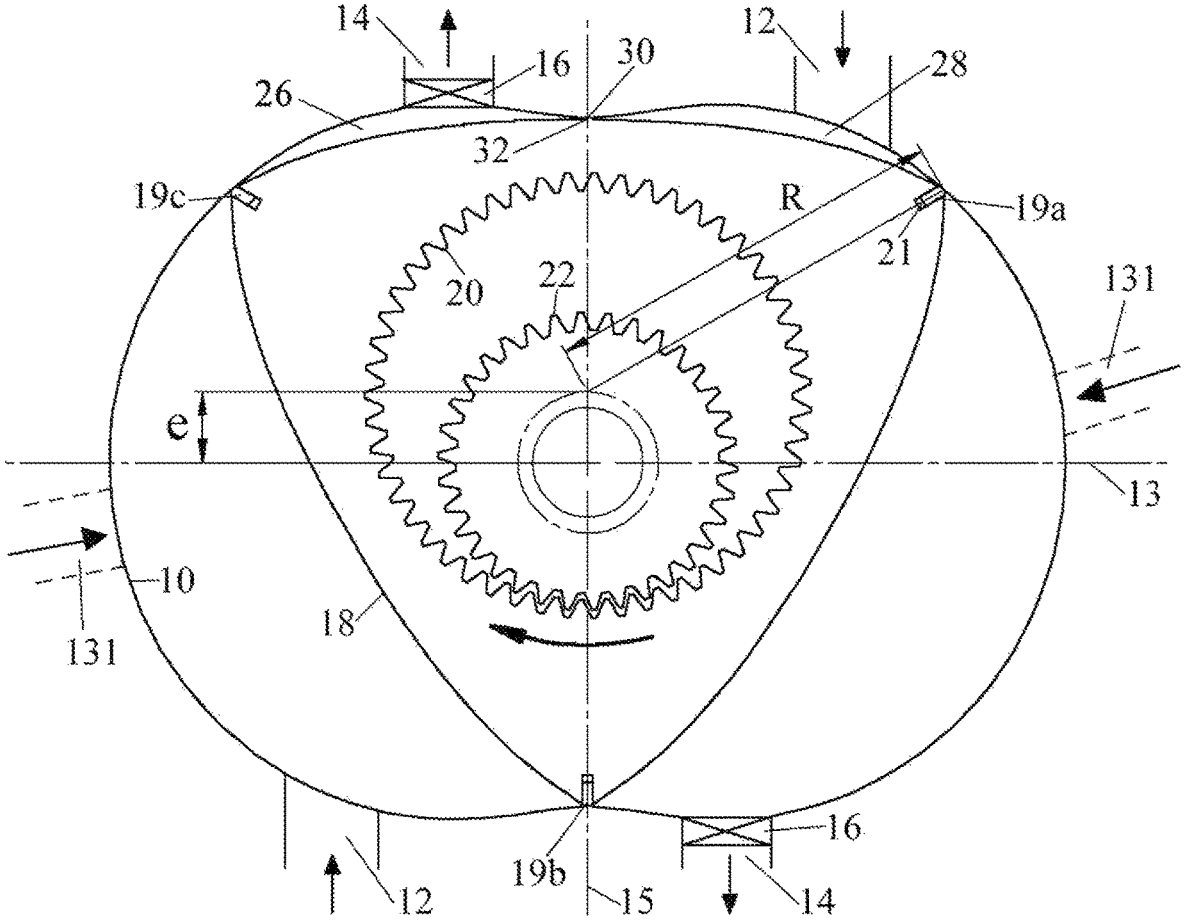
FIG. 1 is a diagrammatic axial view of the housing bore with inlet and outlet ports and with the rotor positioned at TDC.

Referring to the drawings, FIG. 1 illustrates a 2:3 type compressor unit with the rotor 18 at a TDC position. A housing with major axis 13 and minor axis 15 has an epitrochoidal bore 10, inlet ports 12, and exhaust ports 14 each fitted with one-way valves 16. The rotor 18 has a ring gear 20 which engages with a stationary gear 22, the diameter of gear 22 being two thirds the diameter of gear 20. The rotor 18 is fitted with seal pieces 19 at the apices, each seal being supported with a spring 21 such that the seal slidably engages with the bore 10

In its current position, the mid-point 32 of the flank of rotor 18 possesses a close sealing clearance with point 30 of the epitrochoidal bore, point 30 being on the housing minor axis only for this position of the rotor.

Although FIG. 1 only depicts the rotor at the '12 o'clock' position and discusses the sealing features, etc. relating to that position, it should be understood that the 2:3 machine is generally diametrically symmetrical about the machine rotational axis and the same features as 30 and 32 exist on the opposite side of the epitrochoidal bore within the second working chamber such that similar events occur each 180° of shaft rotation.

It will be understood that the gear backlash previously discussed does not materially affect the radial clearance between points 32 and 30, the backlash merely allowing 32 to move tangentially relative to 30. It is therefore practical to provide a working clearance in the tolerance range typically 0.01 to 0.20 mm at this point, 0.01 to 0.10 being preferred. Hence the gas leakage between points 32 and 30 is extremely small due to a combination of this close clearance and the presence of viscous liquid oil particles which assist in the sealing.

Chamber 26 contains high pressure gas which is being forced through the one-way exit valve 16, the gas-oil mixture then passing via an oil separator (not shown) prior to the compressed gas passing into a pressure vessel or receiver (not shown).

Chamber 28 contains only low pressure gas that has substantially entered from the inlet port 12.

Without effective sealing between points 32 and 30 the two equal volume (at TDC) chambers 26 and 28 would, added together, represent the normal DV of this machine, such a large volume being extremely disadvantageous if that volume is re-expanded and returned to the inlet chamber as occurs in the prior art. When sealing between points 32 and 30 exists, as with this invention, it will be understood that as the rotor rotates from the position of FIG. 1 in a clockwise direction the chamber 26 continues to reduce in volume to substantially zero and its contents are generally all forced through the exit valve 16. Chamber 28 continues to fill with fresh intake gas via inlet port 12.

Note that additional inlet ports 131 may be fitted, these ports 131 being used at part load to provide a more energy efficient system than throttling when reduced volumetric efficiency is required.

Figure 2:
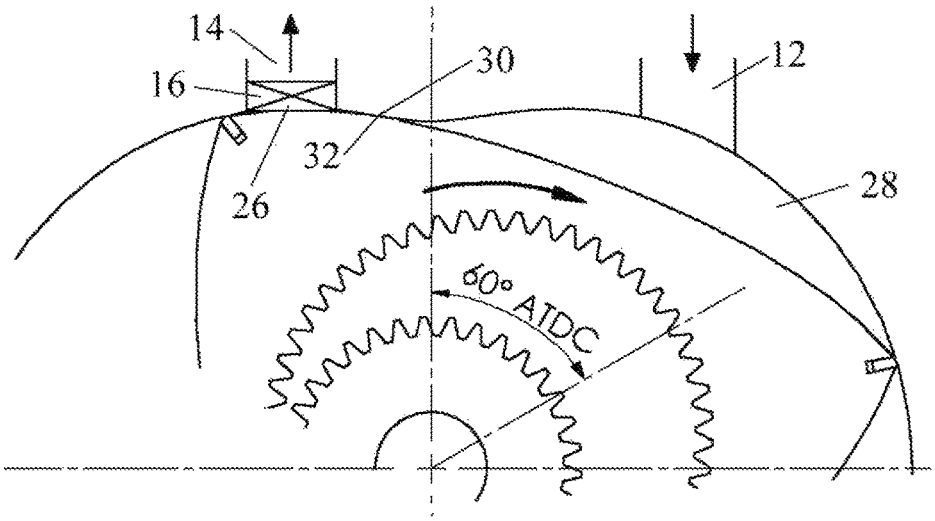
FIG. 2 is a partial view with the rotor positioned 60° after TDC.

FIG. 2 is a partial view with the rotor having moved clockwise to 60° after TDC. For clarification, using conventional Wankel engine terminology, the angular position of a rotor is always described in terms of the angular position of the eccentric shaft on which it is mounted. The rotor only rotates ⅓ as many degrees as the shaft. Chamber 28 generally contains only fresh gas which has entered via inlet port 12 as the continuing first part of the ensuing induction stroke. Chamber 26 now possesses negligible volume.

This volume represents the final DV of this machine. Chambers 26 and 28 are still separated by the small radial clearance between the moving points 32 on the rotor flank and 30 on the epitrochoidal bore. Thereby the design may achieve a primary objective of the invention which is to reduce the DV to a negligible proportion of the so-called swept or intake volume.

Figure 3:
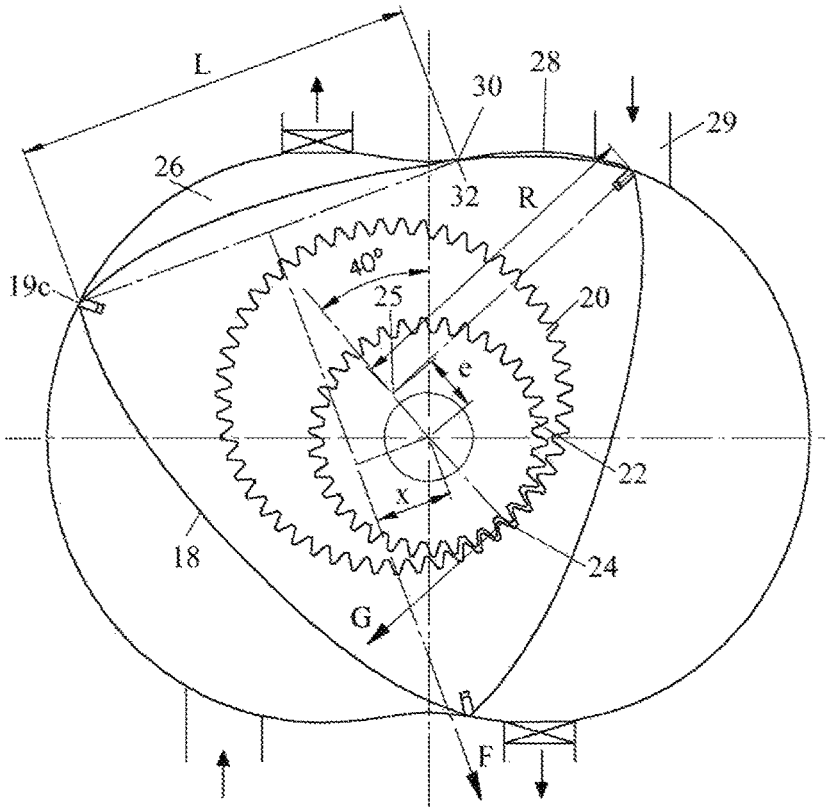
FIG. 3 is an axial view with the rotor positioned 40° before TDC illustrating the gear loading problem.

FIG. 3 illustrates the loading problem on the gears which is caused by disparate gas pressure being applied to different parts of the rotor flank. The rotor 18 is at a typical position of 40° before TDC. Rotor 18 with centre 25 is rotatably mounted on the eccentric shaft (not shown). The point 32 on the rotor flank maintains close sealing proximity with point 30 on the housing bore. Hence the chamber 26 contains high pressure gas; chamber 28 contains low pressure gas which has generally entered via inlet port 29. The high pressure gas of 26, acting on only that part of the area of the rotor flank between 32 and apex 19*c*, results in a force F as shown, the magnitude of this force being a product of the gas pressure value existing in chamber 26, the dimension L as illustrated, and the axial width dimension B of rotor 18.

A resulting torque with a value Fx, x being the distance between force line F and rotor centre 25, acts on rotor 18 which has to be resisted by force G acting tangentially on the gear teeth of 20 and 22 which are in mesh at 24 as shown. This high force G would generally overload the gears of prior art designs of rotor, thereby limiting the operating gas pressure which could be allowed with reliability. A solution to this problem is proposed later in this document. Note that when equal gas pressure is applied to the whole of the rotor flank, as in the Wankel IC engine and generally in prior art compressors, force line F would pass through the rotor centre 25 and no torque load is imposed on the gears.

Figure 4:
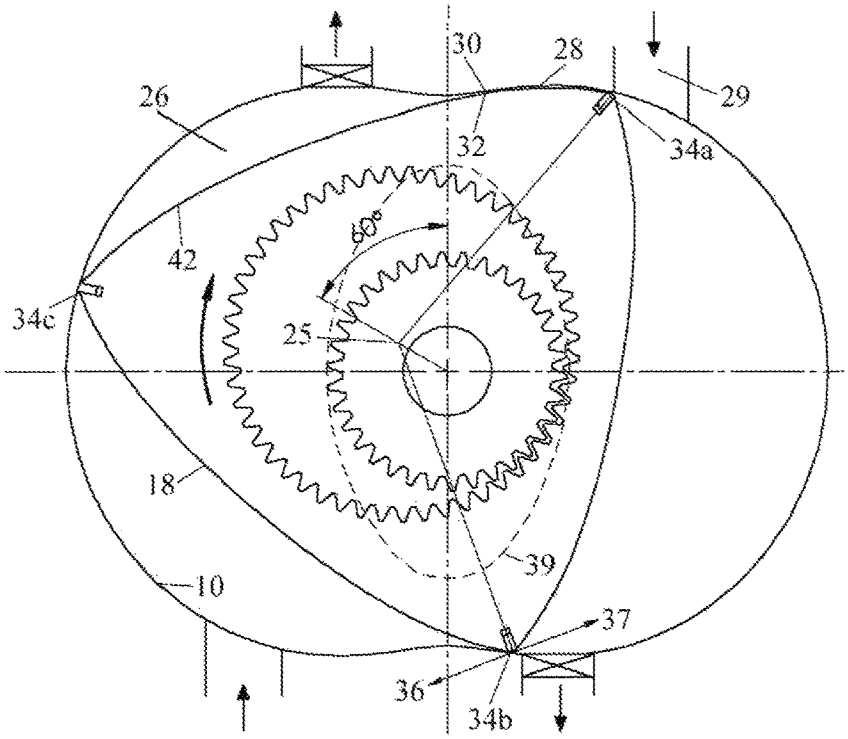
FIG. 4 is a view with rotor positioned 60° before TDC particularly illustrating the gear backlash problem.

FIG. 4 shows the rotor 18 at 60° before TDC. This Figure illustrates those regions of the rotor flank which need to be in close proximity to the housing bore to provide good sealing and those regions of the rotor flank more adjacent to the apices which may possess a larger clearance to the bore because they have no significant influence on the gas leakage from the high pressure to low pressure regions. Point 32 on the rotor flank has close sealing clearance to point 30 on the housing bore which separates chambers 26 and 28. At this position of the rotor, chamber 28 has very small volume and it will be understood that if the rotor was at a slightly earlier, anti-clockwise, position than 60° before TDC, chamber 28 would have quite negligible volume. The apex seal at 34*a* will not have traversed the opening edge of the inlet port 29 and chamber 28 will be therefore a fully closed chamber. Hence there is no requirement for good sealing between the housing bore and that part of the rotor flank between 32 and the apex 34*a*. Point 32 on the rotor flank may have a working clearance to the housing bore at 30 of typically about 0.1 mm progressively increasing towards the rotor apex to typically 0.2 to 0.5 mm at the apex adjacent to 34*a*. This larger clearance adjacent to the apices avoids the problem of the gear backlash combined with other practical manufacturing tolerances allowing the rotor flanks to contact the housing bore. Similarly the part of the rotor flank between point 42 and apex 34*c* may also have such a progressively higher working clearance, points 42 and 32 being equidistant from their respective adjacent apices.

FIG. 4 also illustrates the potential danger of impact at apex 34*b* if sufficient clearance is not provided between the rotor apices and the housing bore. The arrows 36 and 37 (greatly exaggerated in magnitude) show the direction of movement of the rotor apex resulting from gear backlash which allows the rotor to "rock" about its centre 25. It can be seen that movement 36, if the rotor only had a clearance to the rotor bore of maximum 0.1 mm as outlined in GB2215403, would allow the rotor apex 34*b* to impact the housing bore 10 with the likelihood of "spragging" and failure of the machine.

This invention provides for a special shape of the rotor flank such that there is:

- close sealing points between the circumferentially centre region of the rotor flanks and the housing bore which divides the compressed volume into two generally sealed chambers and therefore eliminates the DV problem
- a greater clearance in the regions of the rotor apices where sealing is not required but contact between the rotor and the housing bore must be avoided.

Figure 5:
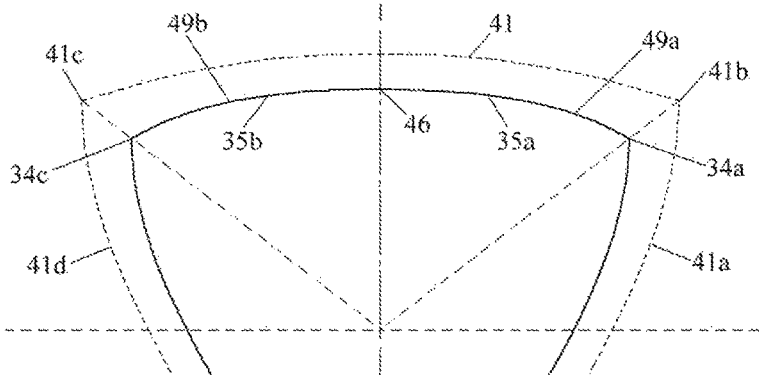
FIG. 5 is an axial view of the preferred rotor flank profile (radially expanded)

FIG. 5 shows in exaggerated form the required shape of the rotor flank in axial view. Line 41 through points 41*a*, 41*b*, 41*c*, and 41*d* represents the so-called 'inner envelope' profile. The inner envelope is the profile of the theoretical maximum size of the rotor flank which would be generated by the rotor being rotated inside the epitrochoidal 2:3 type housing and having zero clearance to the bore. By way of further explanation, the actual point in the housing bore which generates the inner envelope is the same moving point as point 30 in FIGS. 1, 2, 3, and 4 which this invention utilises to create a small radial sealing gap with the associated moving point 32 on the rotor flank, the rotor being slightly undersize to the inner envelope.

In FIG. 5 the portion of the actual rotor flank between points 35*a* to 35*b* is that part which needs to possess a close working clearance to the housing bore, 46 being its central point. The position of point 35*b* is generally defined by it being in the approximate position of point 32 of FIG. 2, i.e. the point adjacent to the housing bore point 30 when the rotor is positioned 60° after TDC. The same applies to point 35*a* when the rotor is positioned 60° before TDC. As in FIG. 1, a radial clearance of typically 0.01 to 0.20 mm exists between 46 and shape 41. The regions of the rotor flank between points 46 and 35*a* and between 46 and 35*b* would possess a progressively increasing value in this range as 35*a* and 35*b* are approached, to ensure that points 35*a* and 35*b* do not contact the housing bore due to any small 'rock' (=rotation) of the rotor as may be allowed by gear backlash. Apices 34*a* and 34*c* may have a radial clearance to shape 41 typically in the preferred range 0.2 to 0.5 mm. The profile of area 49*a* is defined by it possessing a progressively increasing radial distance to shape 41 from the value at point 35*a* to the value at 34*a*. Similarly for area 49*b*. Note that modern CNC machines make the achieving of such above tolerances quite practical.

Figure 6:
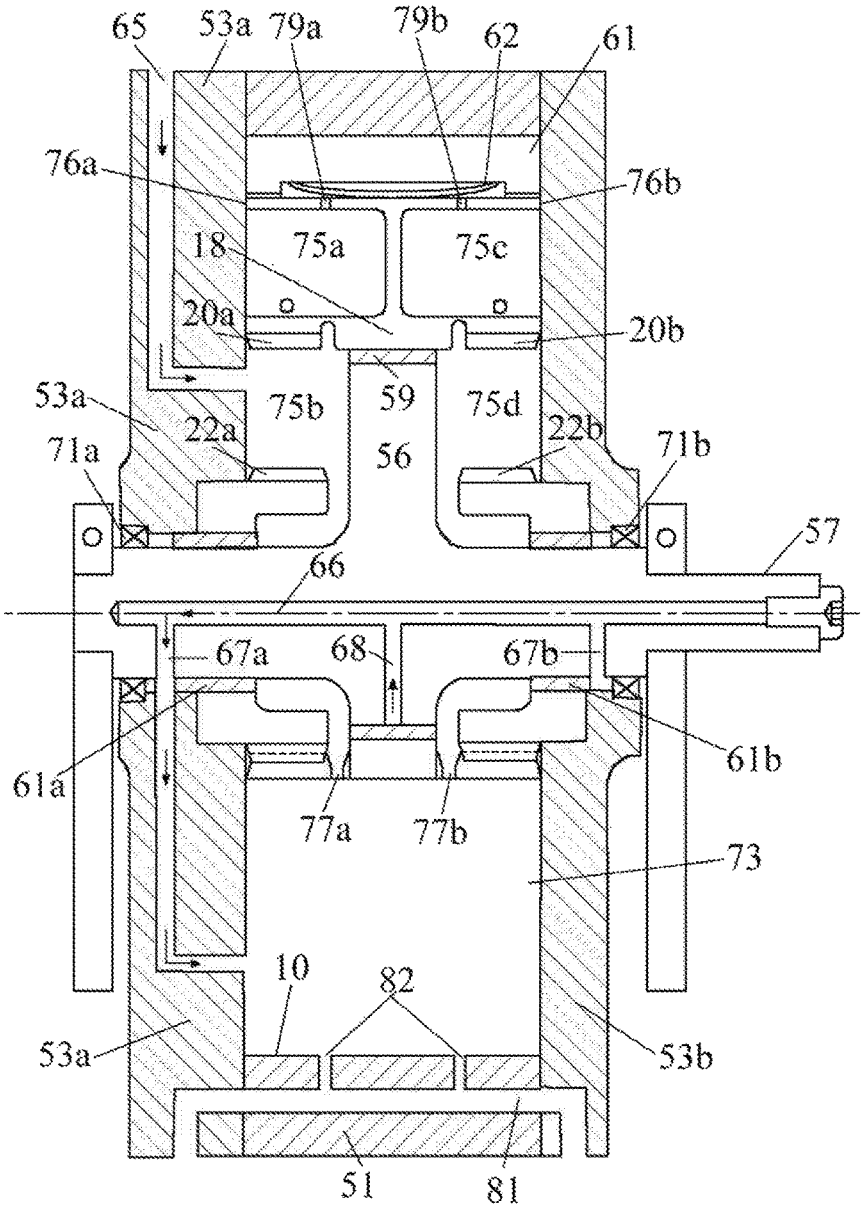
FIG. 6 is a diagrammatic cross section of the machine assembly, particularly illustrating the special gear arrangement.

FIG. 6 gives a sectioned view in the plane of the shaft axis. Housing 51 with bore 10 is located between end plates 53*a* and 53*b*. Rotor 18 is rotatably mounted on the eccentric 56 of shaft 57 via the plain bearing 59 in the rotor bore. The shaft 57 is rotatably mounted in the end plates 53 via plain bearings 61*a* and 61*b*. Oil is continually fed from the external pressurised oil separator and cooler system (not shown) via passage 65 to the rotor internal cavity 75*b*. The opening of 65 in the end plate 53*a* is positioned inside the 'lemon' shaped inner locus of the inner walls of the rotor flanks as shown by dotted line 39 in FIG. 4. A small proportion of this oil flows axially from both outer ends into the rotor bearing 59 and from the inner ends of the main bearings 61 and exits the bearings via radial passages 68 and 67*a* and 67*b* into a central bore 66 in the eccentric shaft 57. This oil passes through passage 69 into the low pressure intake working chambers 73 which contains the gas which is being inducted and compressed. Oil seals 71*a* and 71*b* are mounted in the end plates and sealably engage with the shaft 57.

The common cavity 75*a*, 75*b*, 75*c*, 75*d* within the rotor is generally completely filled with the pressurised oil, this oil removing heat from the rotor. The axial sides or end faces 76*a* and 76*b* of the rotor 18 slidably engage and maintain a small axial clearance with the inner faces of end plates 53*a* and 53*b* respectively. This clearance gap is generally completely filled with oil leaking outwards into the working chambers, and so prevents air which is being compressed in those chambers from leaking radially inwards past the sides of the rotor. This system provides substantially perfect gas sealing at this junction without the need for any space-consuming or friction-adding sealing elements to be fitted in the sides of the rotor.

Radial hole or holes 77*a* and 77*b* in each flank of rotor 18 spray pressurised oil into the working chambers 73, thereby further cooling the gases as well as assisting in providing a lubricating oil film on all the sliding surfaces and adding sealing oil at all the potential gas leakage paths from the working chambers.

Note that, due to centrifugal forces, the pressure of the oil in the radially outer parts of the rotor is generally always higher than the pressure of the compressed air in the working chambers thereby ensuring generally zero leakage flow of the working gas into or past the sides of the rotor.

Each apex of the rotor carries an apex seal 61 supported by a leaf spring 62. Radial hole or holes 79*a*, 79*b* may be provided to supply oil from the rotor cavity 75 to the underside of seal 61. The purpose of this oil supply is to both augment the spring 62 load on each apex seal as well as ensuring that the small working clearances around the apex seals, and the sliding contact point between the apex seal and housing bore, are copiously flooded with oil, thereby ensuring low wear rates for the apex seals 61 plus a high standard of circumferential gas sealing between the adjacent working chambers.

Axial passage or passages 81 may be provided to allow oil to flow through the rotor housing and remove heat from the housing. The passages 81 are so circumferentially positioned and sized such that optimum cooling of housing 51 is achieved thereby maintaining a generally equal axial thermal expansion circumferentially around the housing. It will be arranged that the rotor housing and rotor will be of similar temperature and materials thereby assisting in maintenance of the small axial gap between rotor and end plates hence minimising oil leakage.

Radial holes 82 may be fitted though the housing bore to spray additional oil into the gas being inducted and compressed in order to provide further cooling of the gas, and thereby minimise the compression work. The holes 82 may be particularly located near the two minor axis of the housing bore to ensure that the points 32 on the rotor flank which need to provide sealing with the rotor bore are well supplied with oil.

The total volume of oil that is circulated through the working chambers is generally controlled by the size of the oil holes 77, 79 and 82, and the axial clearance of the rotor to the end plates, and typically amounts to about 1% of the working chamber volume per cycle.

The rotor 18 is fitted with twin ring gears 20*a* and 20*b* which engage respectively with stationary pinion gears 22*a* and 22*b*, these gears being mounted on the end plates 53*a* and 53*b*. The principle of using twin gears, one on each side of the rotor, is given in expired U.S. Pat. No. 4,551,083. A description is provided therein on how it can be arranged that the gear load is shared approximately equally as is desired. The objective stated in '083 was to prevent rotor wobble in trochoidal type rotary machines. In the present invention there is no requirement for this anti-wobble or anti tilting capability because the rotor is constrained from tilting by the rotor axial sides possessing very small clearances to the end plates.

The twin gear arrangement has a novel usage in this invention in that it is the preferred method for increasing the total torque capability of the gear system. Each gear is made to have relatively greater axial width, and hence greater torque capability, than has been typically used in prior art. The problem of excessive gear loading, which exists due to the unsymmetrical gas pressure on the rotor flanks arising from this invention, is therefore overcome. There is no teaching in '083 for this usage.

There is no requirement for the gear teeth of each of the two gears to be in circumferential alignment as claimed in '083 because the pinion with a diameter D is meshing with a ring gear of internal diameter 3/2 D. Hence there is a relatively high tooth contact ratio and the loads are simultaneously shared between several teeth irrespective of the precise angular position of the teeth in each of the two gear pairs.

The use of twin gears is our preferred solution for provision of greater gear torque capacity. However a single gear constructed from high strength material, and then generally not an integral part of the rotor, may be preferred particularly for machines designed for producing lower gas pressures.

The use of plain or sleeve type bearings is preferred for bearings 59, 61*a* and 61*b*, these being lubricated from the available pressurised oil supply. However, needle bearings could be alternatively employed.

Figure 7:
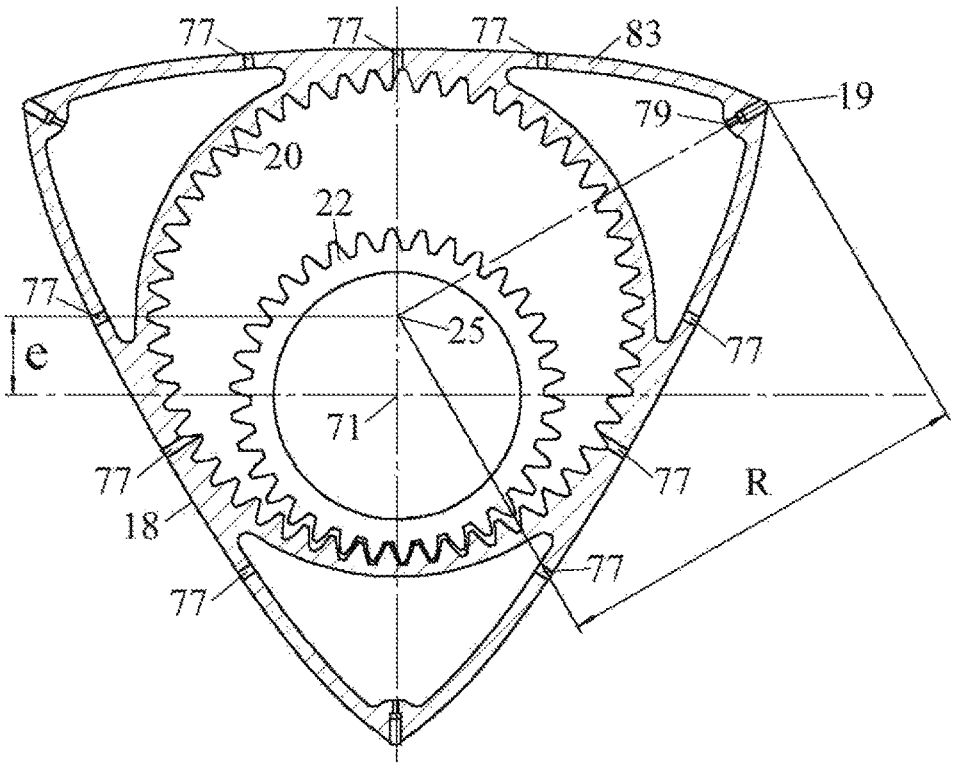
FIG. 7 is an axial view of the rotor illustrating the compactness and gear strength benefits of a rotor with low R/e ratio and without side seals.

FIG. 7 is an axial view/section of the rotor 18. Internal gear 20 engages with stationary gear 22. Axis 71 is the fixed centre of rotation of the eccentric shaft (not shown). Axis 25 is the orbiting centre of rotation of the rotor, the distance between these two centres being the eccentricity "e" as shown. "R" is the dimension from the rotor centre to a rotor apex as shown. Holes 79 feed oil to the slots containing apex seals 19. The cross-hatched outer perimeter axial face 83 slidably engages in close proximity with the adjacent end plate. The axial face 83 can be constructed to possess a radial small dimension because it is not required that side seals are fitted into any of the axial faces as is the convention, a very effective sealing of the working chambers being achieved in this invention by the oil flooding which exists between the end plate surfaces and face 83 as oil leaks out from the rotor interior through the small axial gap into the working chambers.

Omission of the side seals allows a smaller value R/e ratio to be employed because radial space required for side seals between the OD of rotor gear 20 and the rotor flanks does not have to be provided. FIG. 7 illustrates a rotor with R/e=5.3. In prior art, R/e typically has a value in the range 6 to 7. Note that the so-called "capacity" or swept volume of this machine is given by the value of $6\sqrt{3}$ eRB where B is the axial width of the rotor. Hence use of a smaller value of "R" combined with larger value of "e" has many advantages including, and as illustrated in FIG. 7:

a) A physically smaller, more compact and lighter weight rotor, with the associated epitrochoidal housing (not shown) and hence complete machine, for a given swept volume of the working chambers.

b) Reduced mechanical friction losses because at a given RPM all the sliding surfaces such as the face 83 and the apex seals 19 are travelling a reduced distance at slower speed, as well as elimination of all the side seal friction.

c) As illustrated in FIG. 3, the reduced length L reduces the flank area upon which the gas pressure is acting and hence reduces force F, which results in a lower load G on the gears, as is caused by the disparate gas pressure on the rotor flank imposed in this invention.

d) The gears are a larger diameter and hence possess a higher torque capability.

Figure 8:
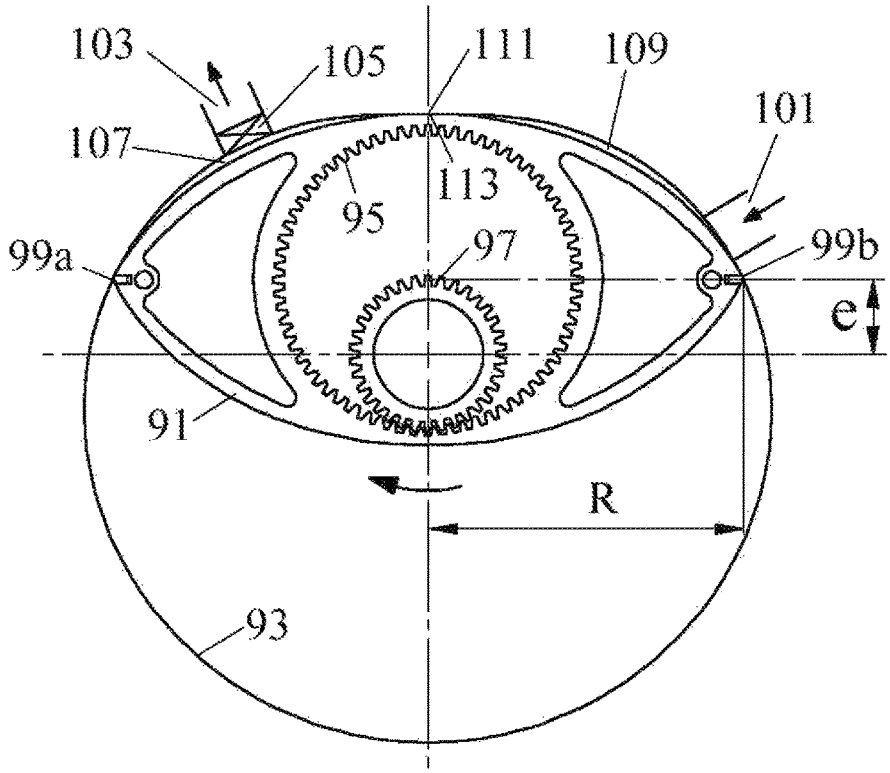
FIG. 8 is a diagrammatic axial view of the alternative type 1:2 machine positioned at TDC.

FIG. 8 shows an axial view of the alternative 1:2 type machine with the rotor 91 positioned at the TDC position inside the epitrochoidal shaped housing with bore 93. The rotor internal gear 95 engages with the stationary pinion 97. In this 1:2 machine gear 95 has twice the PCD value of gear 97. Apex seals 99*a* and 99*b* slidably engage with bore 93. A peripheral inlet port 101 admits gas which after compression is forced out through the exit port 103 fitted with a 1-way valve 105. Chambers 107 and 109 when combined represent the "dead volume" of prior art 1:2 type compressors, and in the prior art this combined volume of compressed gas is all transferred to and re-expanded in the enlarging chamber 109 and thereby enters the following intake chamber resulting in the problems of:

torque reversal much reduced quantity of fresh gas intake resulting in low volumetric efficiency energy wastage With this invention, the rotor flank shape is modified such that the moving point 113 on the rotor flank is in very close sealing proximity to the associated moving point 111 on the housing bore in a similar manner to as in the 2:3 machine described above. Thereby separate chambers 107 and 109 are created wherein chamber 109 essentially contains only fresh gas which has entered via port 101; and the compressed gas in 107 is essentially all forced out through exit valve 105. Consequently the machine possesses, as with the 2:3 type of machine utilising this invention, an extremely low value of DV of generally less than 1%, the actual figure depending mainly on the design of 1-way exit valve being employed. FIG. 8 shows a machine with a relatively small R/e value of about 4.3, thereby possessing the advantages a) to d) as listed in the description of FIG. 7.

Prior art machines of this type have generally used geometry with a higher R/e value in order to have a machine with a smaller DV. A higher R/e value results in a larger rotor 91 in combination with smaller diameter gears 95 and 97. Hence such gears, and the eccentric shaft which generally has to possess a sufficiently small diameter to pass through the bore of gear 97, have reduced torque capability and may be unable to withstand any dynamic torsional vibrations which may occur.

In all the above descriptions it will be understood that, where specific values of dimensions are given, they apply to a typical mid-sized compressor. Larger machines, or smaller machines, to which this invention is also applicable, would use different but appropriate values.

Whilst the invention has been described with reference to the compressor duty, it will be apparent that it may be equally applicable to a vacuum pump, the minimising of the DV value being a long sought after and particular advantage in such machines.

Whilst the invention has been described with reference to a single-rotor machine it will be apparent that it is equally applicable to machines of the kind referred to having two or more rotors, generally using a common shaft.

Although this invention has been illustrated and described with reference to the preferred embodiments thereof it is to be understood that it is in no way limited to the details of such embodiments but is capable of numerous modifications within the scope of the appended claims.

The invention claimed is:

1. A rotary piston compressor comprising:

a housing having an epitrochoidal shaped inner bore, peripheral inlet and exhaust ports located in the inner bore, and end plates for the housing; and a rotary piston rotatably mounted within the housing and defining working chambers between the rotary piston and the housing, wherein the rotary piston has a rotor, apex seals located in apices of the rotor, a flank extending between the apices and having a profile, and axial end faces of the rotor are in close sealing proximity to the inner surfaces of the end plates, characterized in that the profile of a central portion of the rotary piston flank between the apices is configured such that, at a closest point between the central portion of the piston flank and the housing between the exhaust port of a trailing compression cycle and the inlet port of a leading compression cycle, radial spacing between the flank of the rotary piston and the housing is maintained such that, in use, volumes enclosed by the rotary piston on either side of the closest point in the respective trailing and leading compression cycles are substantially sealed from one another, profiles of end portions of the rotary piston flank are configured with a reduced radius of curvature relative to the central portion of the rotary piston flank such that an increased radial spacing between the rotary piston flank and the housing is provided compared to that between the central portion of the piston flank and the housing, and wherein the rotary piston is configured and arranged with the housing to air seal the working chambers at a junction of the axial end faces of the rotor and the end plates by supplying pressurized oil to internal cavities of the rotor and passing the pressurized oil outwards from an interior of the rotor and filling an axial gap at the junction with the oil.

2. The compressor of claim 1, wherein the rotary piston is configured and arranged with the housing to, in use, continually leak oil outwards from the entire circumference of both rotor sides into the working chambers;

the volume enclosed between the rotor flank, inner bore and end plates is divided into two separate chambers including one leading chamber and one trailing chamber, which are substantially sealed from each other; and the trailing chamber contains pressurized gas and communicates solely with the exhaust port, the circumferential location of the exhaust port being such that it is adjacent to the volume in the chamber when the volume is at a minimum.

3. The compressor of claim 1, wherein the volume enclosed between the rotor flank, inner bore and end plates is divided into two separate chambers including one leading chamber and one trailing chamber, which are substantially sealed from each other; and the leading chamber contains low-pressure fresh intake gas and communicates solely with the peripheral inlet port, the circumferential location of the port being such that it is adjacent to the volume in the chamber when the volume is at a minimum.

4. The compressor of claim 1, having a dead volume of 1% or less.

5. The compressor of claim 1, wherein, when the rotor is positioned at a Top Dead Center (TDC) position and has the flank, the circumferential midpoint of the rotor flank has a radial clearance to the inner bore of the housing selected from the group of: 0.20 mm or less, 0.10 mm or less, 0.01 mm to 0.20 mm, and 0.01 mm to 0.10 mm.

6. The compressor of claim 5, wherein the closest point between the central portion and the housing moves along the rotor flank and housing as the rotor flank rotates within the housing, and the two points on the rotor flank which are closest to the housing inner bore when the rotor is positioned 60° before and 60° after the TDC have a radial clearance to the housing inner bore which is approximately 0.1 mm greater than the radial clearance at the circumferential mid-point of the rotor flank to the housing inner bore.

7. The compressor of claim 6, wherein the rotor flank profile between the mid-point of the rotor flank and the closest points at 60° before and 60° after TDC has a progressively and evenly increasing radial clearance to the housing inner bore.

8. The compressor of claim 1, wherein the flank of the rotor immediately adjacent to the apices has a radial clearance to the housing inner bore of 0.5 mm or less and preferably 0.20 mm to 0.50 mm.

9. The compressor of claim 8, wherein the rotor flank profile between the closest points at 60° before and 60° after TDC and the points on the rotor flank adjacent to the rotor apices has a progressively and evenly increasing radial clearance to the housing inner bore.

10. The compressor of claim 1, further comprising oil in the chambers and configured and arranged for lubrication, cooling and gas sealing.

11. The compressor of claim 1, wherein the rotary piston is configured to supply the pressurized oil via an axial passage through one of the end plates to the internal cavities of the rotor.

12. The compressor of claim 11, wherein the axial passage is located inside the inner locus of the rotor perimeter, and configured to substantially fill the internal cavities of the rotor with the pressurized oil.

13. The compressor of claim 11, wherein holes are located in the rotor flanks such that oil is sprayed out from the holes into the chambers thereby assisting mixing with and cooling of the compressed air in the chambers combined with depositing oil on end casings and inner bore surfaces of the housing.

14. The compressor of claim 11, wherein radial holes are provided between a cavity of the rotor and the apex seals which allow the pressurized oil from inside the rotor to supply oil to the apex seals.

15. A compressor of claim 11, further comprising a twin gear system, whereby a stationary gear is mounted on each end plate and a ring gear is integrated into each axial end of the rotor whereby each ring gear engages with one of the stationary gears such that the gear load capability is enhanced.

16. The compressor of claim 1, wherein the inner bore of the housing has a two-lobed epitrochoidal shaped inner bore, the compressor has a shaft journalled in the end plates, and the rotary piston has three flanks and is mounted on the shaft eccentrically with respect thereto and geared to rotate at one third speed of said shaft.

17. The compressor of claim 16, wherein the profile of the central portion of each of the rotary piston flank is configured such that, as the shaft rotates from a position approximately 60° before a Top Dead Center (TDC) to approximately 60° after the TDC, a volume enclosed between each of the flank of the rotor, the inner bore and the end plates is continuously divided into two separate chambers, one leading, one trailing, which are substantially sealed from each other by radial closeness of a moving point on the rotor flank to an associated moving point on the inner bore of the housing.

18. The compressor of claim 17, wherein the profiles of the end portions of the rotary piston flank outside the central portion are configured such that the rotor flank exhibits a radial size and radial clearance relative to the inner bore of the housing such that no part of the end portions impact the inner bore of the housing.

19. The compressor of claim 16, having an R/e value of less than 5.3, where R is a radius of the rotor and e is an eccentricity of the shaft.

20. The compressor of claim 1, wherein the inner bore has a one-lobed epitrochoidal shape, the compressor has a shaft journaled in the end plates, and the rotary piston has two flanks and is mounted on the shaft eccentrically with repect thereto and geared to rotate at one half speed of said shaft.

21. The compressor of claim 20, having an R/e value of less than 4.3, where R is the radius of the rotor and e is an eccentricity of the shaft.

22. The compressor of claim 20, wherein the profile of a central portion of each rotary piston flank is configured such that, as the shaft rotates from a position approximately 60° before TDC to approximately 60° after TDC, the volume enclosed between the rotor flank, inner bore and end plates is continuously divided into two separate chambers, one leading, one trailing, which are substantially sealed from each other by the radial closeness of a moving point on the rotor flank to an associated moving point on the inner bore of the housing.

23. The compressor of claim 22, wherein the profiles of the end portions of the rotary piston flank outside the central portion of the rotary piston flank are configured such that the rotor flank exhibits a radial size that provides radial clearance to the inner bore of the housing such that no part of the end portions impact the inner bore of the housing.

* * * * *